US005099527A

United States Patent [19]

Roose

[11] Patent Number: 5,099,527

[45] Date of Patent: Mar. 31, 1992

[54] SPLASH DEFLECTOR

[76] Inventor: Lars D. Roose, 10100 Chapala Ct., NE., Albuquerque, N. Mex. 87111

[21] Appl. No.: 493,146

[22] Filed: Mar. 9, 1990

[51] Int. Cl.[5] ..... E03D 11/00

[52] U.S. Cl. ..... 4/255; 4/257; 294/131

[58] Field of Search ..... 4/255–257, 4/191, DIG. 4, 661, 300.3; 15/210 B, 248 R, 256.6; 220/90.4, 229; 215/1 A; 294/131; 81/176.1, 176.15, 176.2, 176.3; 30/295, 323; 431/292; 277/212 FB, DIG. 4; 141/97, 390, 392

[56] References Cited

U.S. PATENT DOCUMENTS

| | | | |
|---|---|---|---|
| 186,206 | 1/1877 | Hawley | 4/255 |
| 219,428 | 9/1879 | Armstead | 4/255 |
| 811,742 | 2/1906 | Petrie | 294/131 X |
| 1,253,363 | 1/1918 | Farr et al. | 15/210 B |
| 1,501,020 | 7/1924 | Small | 30/295 X |
| 1,658,645 | 2/1928 | McGee | 239/288 |
| 2,039,792 | 5/1936 | Harder | 4/257 |
| 2,047,580 | 7/1936 | Dewey | 137/379 X |
| 2,066,773 | 1/1937 | Felice | 4/255 |
| 2,457,128 | 12/1948 | Churnell | 15/256.6 X |
| 2,496,525 | 2/1950 | Eggleston | 4/255 |
| 2,510,114 | 6/1950 | Hummel | 15/210 B |
| 2,529,587 | 11/1950 | Bates et al. | 4/257 |
| 2,568,247 | 9/1951 | Medearis | 15/210 B |
| 2,573,213 | 10/1951 | Miller | 4/DIG. 4 |
| 2,611,146 | 9/1952 | Buckley | 15/210 B |
| 2,670,143 | 2/1954 | Jordan | 4/287 |
| 2,793,373 | 5/1957 | Ewing | 4/191 |
| 3,014,389 | 12/1961 | O'Hara | 81/176.2 |
| 3,083,919 | 4/1963 | Farner | 241/99 |
| 3,193,845 | 7/1965 | Funk | 4/300.3 |
| 3,208,092 | 9/1965 | O'Leary | 25/257 |
| 3,438,527 | 4/1969 | Gamblin, Jr. | 215/1 A |
| 3,481,227 | 12/1969 | Shook | 81/176.1 |
| 3,491,379 | 1/1970 | Parrish | 4/661 X |
| 3,739,988 | 6/1973 | Kisor et al. | 141/392 X |
| 3,801,998 | 4/1974 | Macias | 4/DIG. 4 |
| 4,060,859 | 12/1977 | Anderson | 4/102 |
| 4,133,062 | 1/1979 | Fulbright, Jr. | 4/251 |
| 4,190,910 | 3/1980 | Teglund et al. | 4/421 |
| 4,238,860 | 12/1980 | Dixon | 4/256 |
| 4,329,857 | 5/1982 | Kittle et al. | 220/229 |
| 4,458,368 | 7/1984 | Webb | 4/257 |
| 4,502,606 | 3/1985 | Shillington et al. | 220/229 X |
| 4,630,834 | 12/1986 | Müller et al. | 277/212 FB |
| 4,745,641 | 5/1988 | Tash | 4/255 |
| 4,774,730 | 10/1988 | Ho | 4/300.3 |
| 4,831,669 | 5/1989 | Edwards | 4/257 |
| 4,922,555 | 5/1990 | Bonilla et al. | 4/257 |
| 4,948,009 | 8/1990 | Sawatani | 220/229 |

FOREIGN PATENT DOCUMENTS

| | | | |
|---|---|---|---|
| 681664 | 3/1964 | Canada | 4/255 |
| 339729 | 11/1989 | European Pat. Off. | 220/229 |
| 2380754 | 10/1978 | France | 15/248 R |
| 668987 | 3/1952 | United Kingdom | 15/210 B |

*Primary Examiner*—Henry J. Recla
*Assistant Examiner*—Robert M. Fetsuga
*Attorney, Agent, or Firm*—Deborah A. Peacock; Donovan F. Duggan

[57] ABSTRACT

A splash deflector for plungers or the like for deflecting splashes having a disc with a circumferential lip on one side thereof. A plurality of stiffening ribs and anti-tearing ribs and openings may be provided on the disc. The top surface of the disc may bear indicia thereon, such as advertising. The disc is positioned on a handle and attached thereto via flaps formed by selectively slitting the disc. An installation apparatus is also provided for alternating the direction of flap displacing forces, providing an even tighter gripping force to a force-cup handle or the like.

18 Claims, 6 Drawing Sheets

SPLASH DEFLECTOR

BACKGROUND OF THE INVENTION

1. Field of the Invention (Technical Field)

The invention relates to splash suppression or deflection while clearing obstructions in toilet bowls and the like; more particularly it relates to a splash deflector attachable to a plunger, such splash deflector preventing noisome water from splashing back upon the plunger operator, and a method for its mounting.

2. Description of the Related Art Including Information Disclosed under 37 C.F.R. §§1.97-1.99 (Background Art)

Force cups, plungers, or "plumber's helpers" are well known, both to practitioners of the plumbing arts and homemakers. Such plungers normally have a hemispherical rubber cup with handle attached. Manual reciprocation of the handle alternately compresses and expands the rubber cup, in turn applying pressure and suction to an obstructed fluid flow line, thereby clearing the line. The plunger works best when operated vigorously, which increases the chances for splashing, often directed at the operator. U.S. Pat. No. 2,066,773, to Felice entitled Drain and Flushing Apparatus; U.S. Pat. No. 2,496,525, to Eggleston, entitled Cleaner for Drain Pipes; U.S. Pat. No. 4,238,860, to Dixon, entitled Water-Pressure, Drain-Cleaning Device; and U.S. Pat. No. 4,745,641, to Tash; entitled Toilet Bowl Plunger, disclose such plungers wherein apertures for fluid passage through the force cup are provided. U.S. Pat. No. 2,844,826 to Cheiten, entitled Pressure Device, discloses a force cup having a flanged rim and a guide portion. None of these patents, however, teach splash suppression or prevention or deflection means associated with a plunger.

U.S. Patent No. 2,039,792, to Harder, entitled Drain Cleaning Device; U.S. Pat. No. 3,193,845, to Funk, entitled Splash Shield; U.S. Pat. No. 4,060,859, to Anderson, entitled Male Urinating Aid; U.S. Pat. No. 4,133,062, to Fulbright, Jr., entitled Lifting Apparatus for Toilet Seat; and U.S. Pat. No. 4,831,669, to Edwards, entitled Plunger Splash deflector for a Toilet Bowl, while generally disclosing splash suppression means associated with toilets, likewise fail to disclose splash prevention means in combination with a plunger.

Similarly, U.S. Pat. No. 3,208,092 to O'Leary, entitled Cleaning Device; U.S. Pat. No. 2,529,587, to Bates, et al., entitled Toilet Seat for Augmenting the Flushing Capacity of Toilet Tanks in Unstopping Sewers; U.S. Pat. No. 3,491,379, to Parrish, entitled Cleaning Apparatus for Water Closets and the Like, all disclose splash shields in association with toilets, not plungers.

U.S. Pat. No. 4,458,368, to Webb, entitled Plunger with Anti-Splash Shield, teaches a cone-shaped splash shield adjustably secured to a toilet bowl. A plunger is slidably engaged with the shield.

U.S. Pat. No. 3,083,919, to Farner, entitled Safety Bottle Breaker, although unrelated to the plunging art, discloses a bar slidably engaged with a shield.

It is then seen that a need exists in the plumbing art for a simple, reliable, efficient, and inexpensive splash-guard mountable directly upon a plunger. The prior art devices are generally cumbersome, bulky devices that require adjustment as well as physical attachment to a basin or toilet bowl.

SUMMARY OF THE INVENTION (Disclosure of the Invention)

In accordance with the present invention, there is provided a splash deflector comprising a circumferential lip on one surface thereof and a plurality of slits defining a plurality of flaps on the disc.

In the preferred embodiment, the circumferential lip curves downwardly from the surface of the disc. The lip may also curve inwardly to further deflect the splash.

The slits and the flaps of the preferred embodiment extend radially from the center of the disc. The slits may meet at the center of the disc or at a central generally circular opening in the disc. The flaps are preferably generally triangular in shape.

The preferred embodiment comprises structure for stiffening the disc, such as a plurality of stiffening ribs disposed on at least one surface of the disc. There is further provided structure for preventing tearing or ripping of the disc, circumscribing the flaps on at least one surface of the disc or on both sides of the disc. This structure may be a plurality of adjacent ribs or a continuous circular rib. The circular openings at the ends of the slits also prevent tearing or ripping of the disc.

In the preferred embodiment, the other surface of the disc (the "top" side) may bear useful indicia, such as advertising, thereon.

In another embodiment there is provided a combination of an elongate handle and the splash deflector discussed above. This combination is particularly useful for plungers.

There is further provided an installation apparatus, in accordance with the present invention, for mounting a splash deflector or other planar-shaped attachment on an elongate handle. This apparatus comprises a multi-fingered tube, whereby alternate flaps of the splash deflector disc or other attachment are bent downwardly from the plane of the disc by the multi-fingered tube when mounting the disc and alternate flaps are bent upwardly from the plane of the splash deflector disc by either end of the elongate handle.

A primary object of the invention is to provide an improved splash deflector readily attachable to the handle of a plunger or the like.

Another object of the invention is the provision of a simple, reliable, and effective splash deflector which is inexpensive to fabricate.

Yet another object of the invention is to provide a new and effective medium for advertising.

One advantage of the present invention is the capability of selectively positioning the splash deflector upon the handle of a plunger or the like.

Yet another advantage of the present invention is the ease with which the splash deflector may be replaced.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention.

Figure 1:
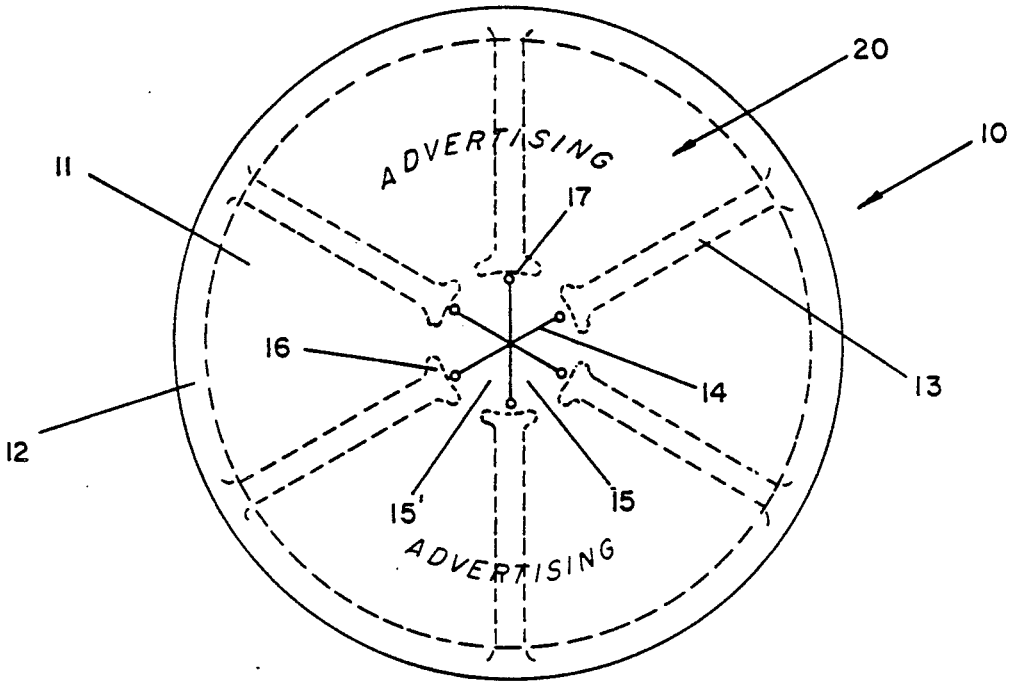
FIG. 1 is a top view of the invention.
Figure 2:
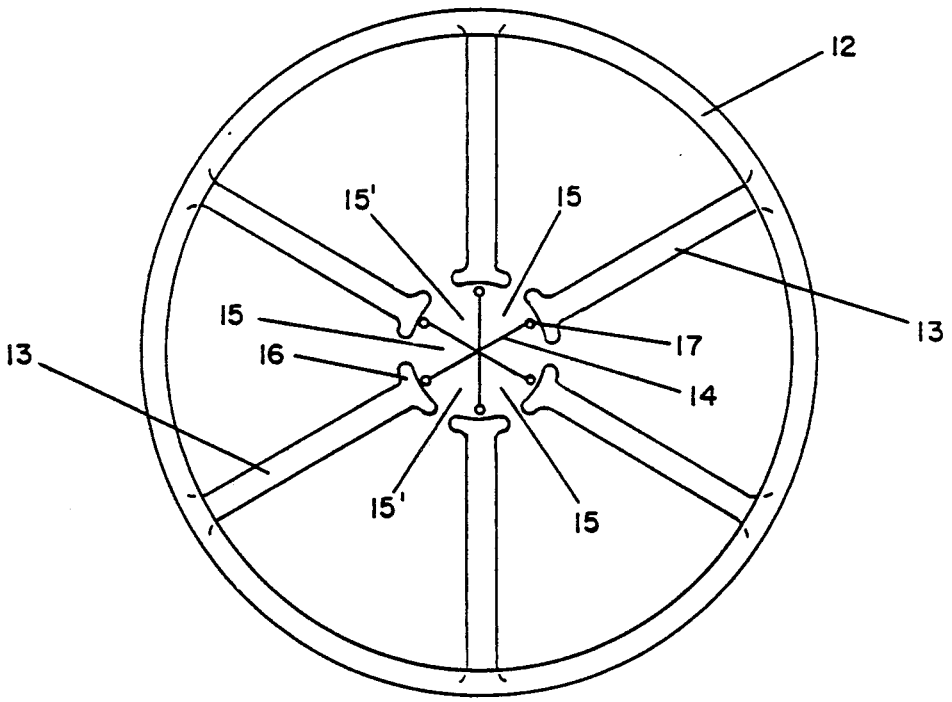
FIG. 2 is a bottom view of the FIG. 1 embodiment.

DETAILED DESCRIPTION OF THE PREFERRED EMBODIMENT OF THE INVENTION (BEST MODES FOR CARRYING OUT THE INVENTION)

Reference is made to the drawings which show various splash deflector embodiments of the invention. As seen therein, the splash deflector 10 comprises a disc 11, preferably of thin plastic, metal, or the like, having a circumferential lip 12 on one side of the disc. Disc 11 and lip 12 divert and deflect soiled water splashes from contaminating the plunger operator during operation of a plunger. The Preferred lip 12, curves downwardly 18 (see FIGS. 3 and 4) so that water is redeflected towards the plunger cup. The preferred lip 12 may also curve inwardly 19 to provide for redeflection of water further towards the plunger handle or cup.

In the embodiment such as shown in FIGS. 1–4 and 8–9, disc 11 is provided with a plurality of stiffening ribs 13 on at least one surface of the disc. Such stiffening ribs 13 provide a desired degree of rigidity and stiffness to disc 11. The number of stiffening ribs, width and depth of ribs (e.g., compare FIGS. 1–4 with FIGS. 8–9), location of ribs (e.g., compare FIGS. 1–4 with FIGS. 8–9), and spacing between stiffening ribs is not critical and may vary, so long as appropriate rigidity is provided to disc 11. Such ribs may be formed, for example, by lateral compression, molding, extruding, welding, brazing, soldering, or by any other means or methods resulting in a desired degree of rigidity. Although the drawings illustrate stiffening ribs 13 on only the bottom surface of disc 11, stiffening ribs may be located on both surfaces or one set of stiffening ribs may be seen on both surfaces.

Figure 10:
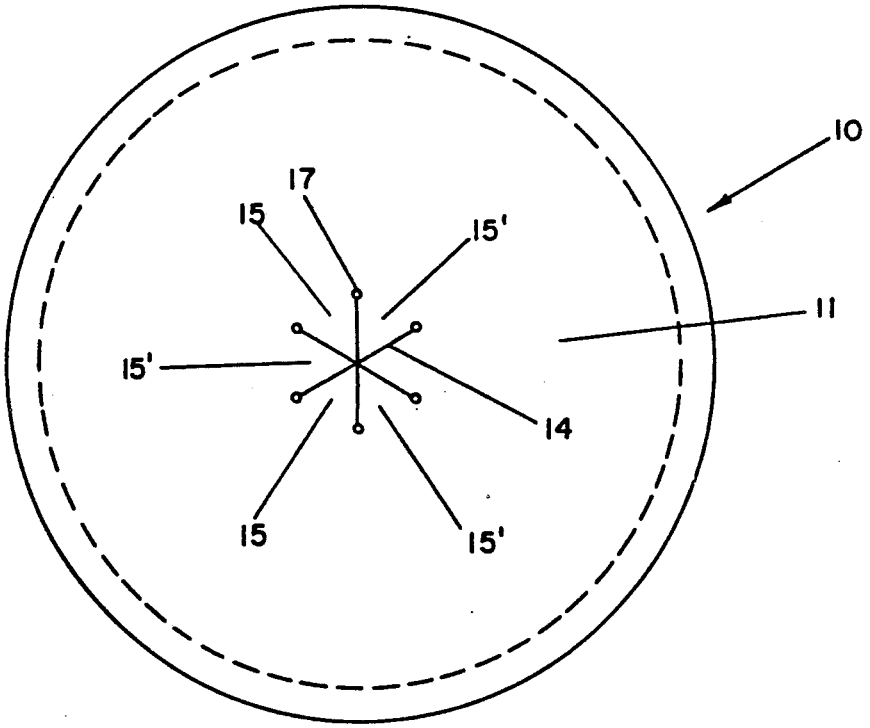
FIG. 10 is a top view of another alternative embodiment.
Figure 11:
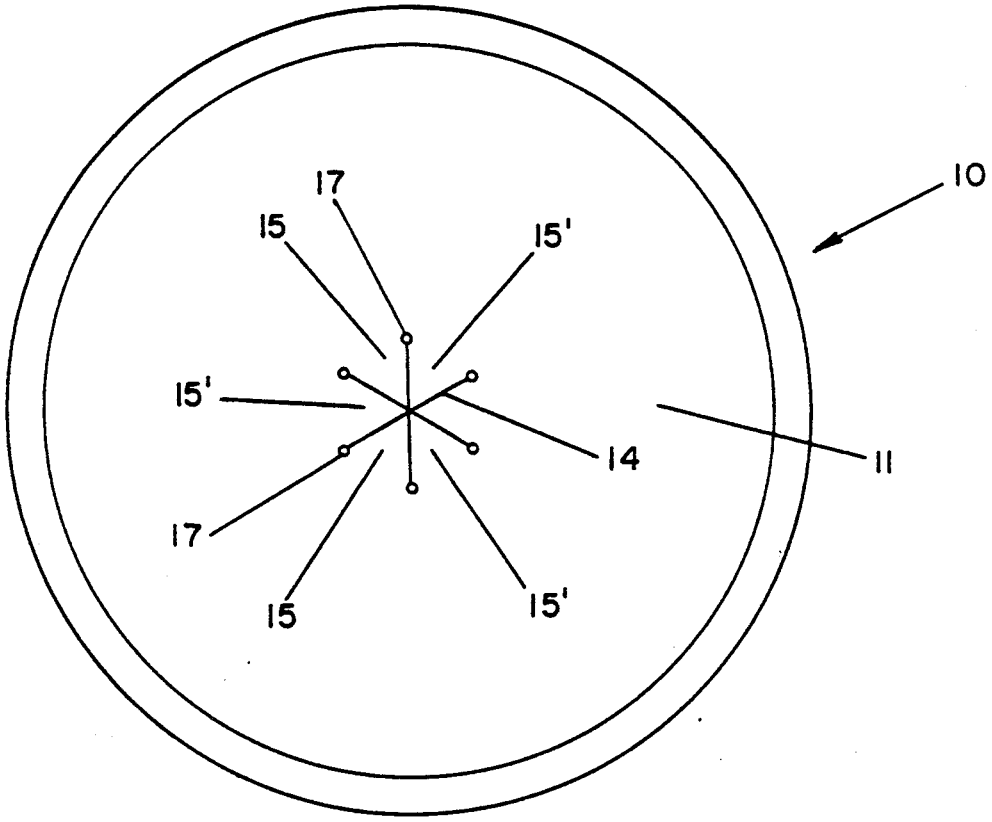
FIG. 11 is a bottom view of the embodiment of FIG. 10.

FIGS. 10 and 11 illustrate an alternative embodiment which does not have stiffening ribs. In such an embodiment, disc 11 should be of a sufficiently thick and rigid material so that reinforcement or stiffening is not necessary.

Figure 8:
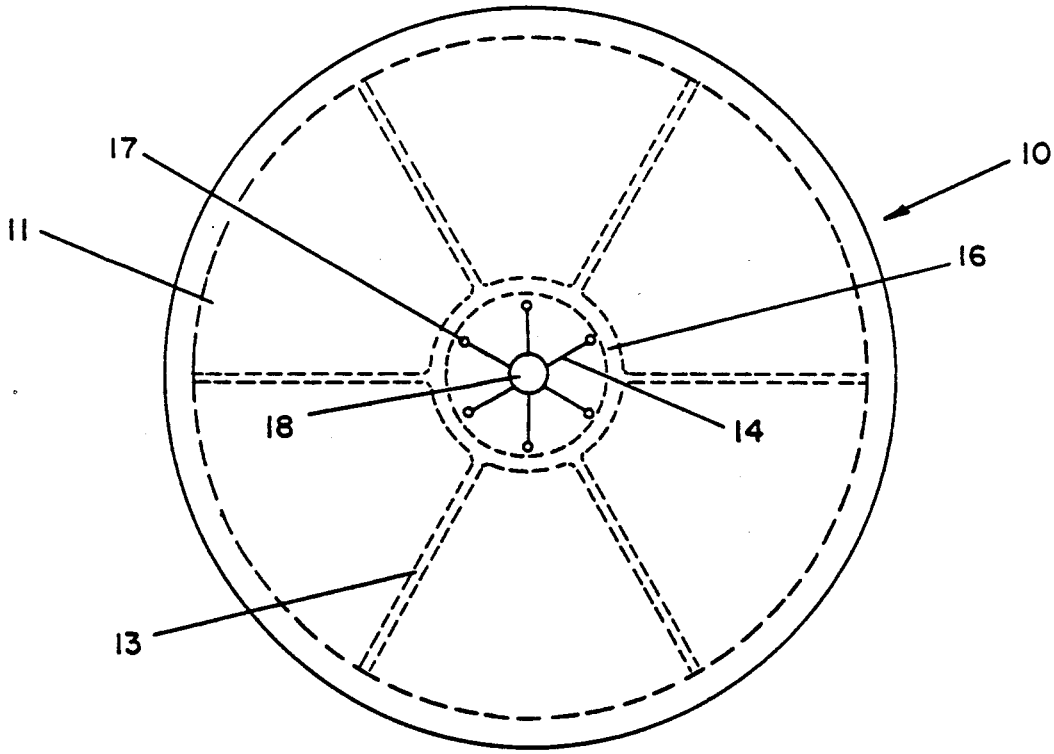
FIG. 8 is a top view of an alternative embodiment.
Figure 9:
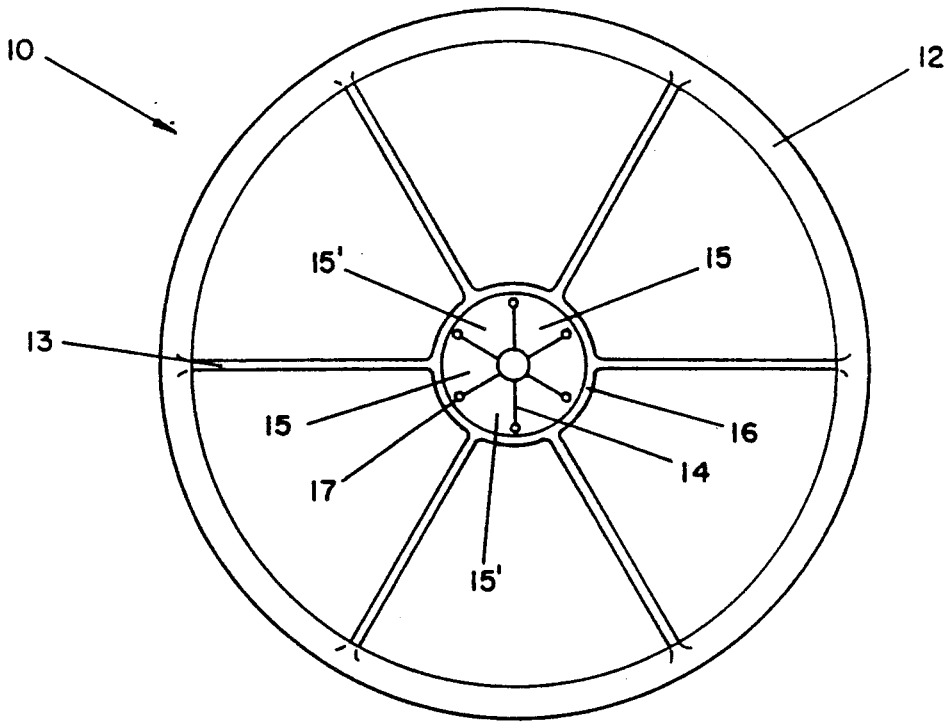
FIG. 9 is a bottom view of the embodiment of FIG. 8.

As shown in the drawings, a plurality of slits 14 are disposed in disc 11, thereby preferably forming triangularly-shaped flaps 15,15'. Each slit 14 extends radially outwardly from the center of disc 11. The exact number, length and width of slits 14 (and resulting triangularly-shaped flaps 15,15') is not critical to the invention except that there be a sufficient number of slits 14 to allow disc 11 to be positioned on a handle, such as a plunger handle 31. Further, of course, the length of the slits 14 should be sufficient to accomodate the handle 31 upon which the disc 11 will be mounted. The slits 14 may meet at the center of disc 11, as shown in FIGS. 1–7 and 10–11 or they may extend radially outwardly from a central opening 18, such as shown in FIGS. 8 and 9, to assist in placement of disc 11 over the handle 31. In the latter embodiment, the flaps 15,15' are more trapezoidal in shape. The term "triangularly-shaped," as used throughout the specification and claims, is intended to include all such shapes, as well as other shapes. The slits 14 preferably terminate at a small circular opening 17, at the base of the flaps 15,15', such as shown in FIGS. 1–3, 5–6 and 8–11. These openings 17 help to prevent circumferential tearing or ripping.

In the preferred embodiment, with specific reference to FIG. 1, the top surface of disc 11 may have indicia emblazoned thereon, such as printed or embedded advertising 20, directions for assembly, and the like. Advertising 20 on disc 11 is particularly useful for plumbers because if the plunger operator is unable to successfully clear the line with the plunger, the advertising 20 will readily encourage the plunger operator to contact the plumber or drain cleaning service which is advertised on the disc 11.

Also, in the preferred embodiment, circumferential rib means 16 circumscribe flaps 15,15'. Such circumferential rib means 16 prevent outward tearing of slits 14 resulting in more stable attachment of disc 11 to elongate handle 31. Such circumferential rib means 16 may be formed, for example, by lateral compression, molding, extruding, welding, brazing, soldering, or by any other means or methods resulting in a circular thickening and reinforcement of material circumscribing the flaps 15,15'. The circumferential rib means 16 may be a plurality of separate ribs which circumscribe the flaps 15,15' such as the embodiment shown in FIGS. 1–4, or may completely circle flaps 15,15' such as shown in FIGS. 8 and 9. Although the drawings illustrate circumferential rib means 16 only on the bottom surface of disc 11, these circumferential rib means may be present on the top surface, bottom surface, or both. Different types, shapes, number, location and spacing of circumferential rib means may be disposed on disc 11.

Figure 3:
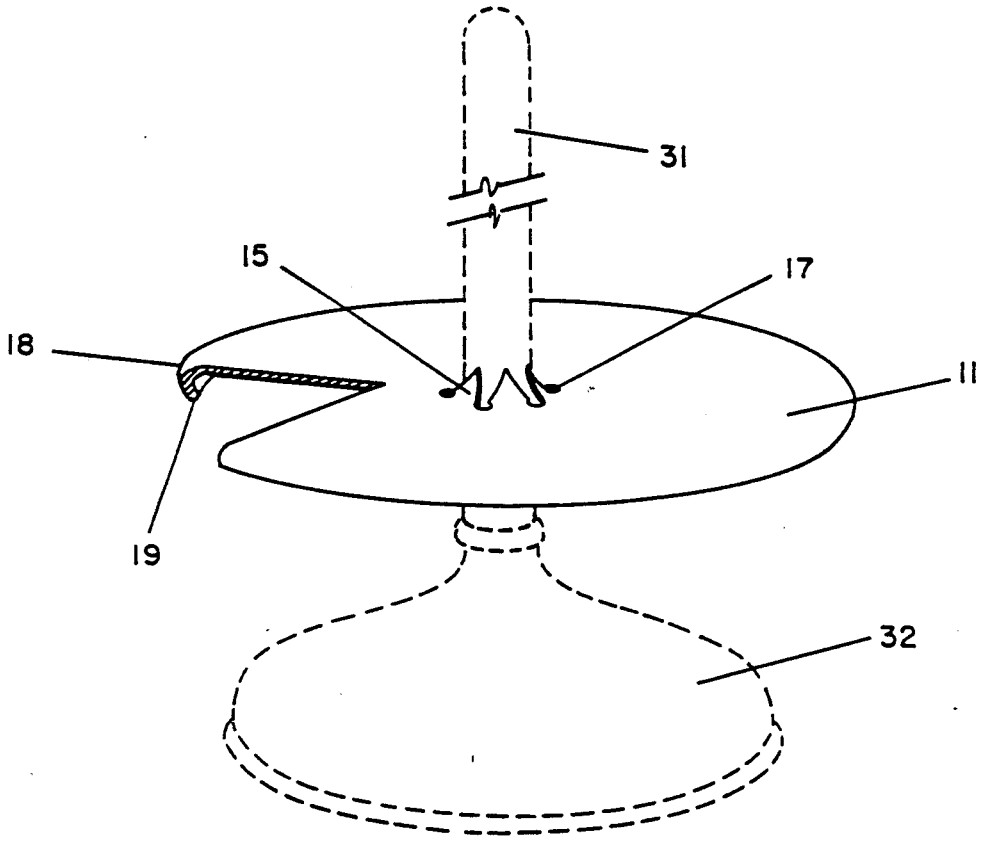
FIG. 3 is a top perspective view of the FIG. 1 embodiment mounted upon a plunger handle.
Figure 4:
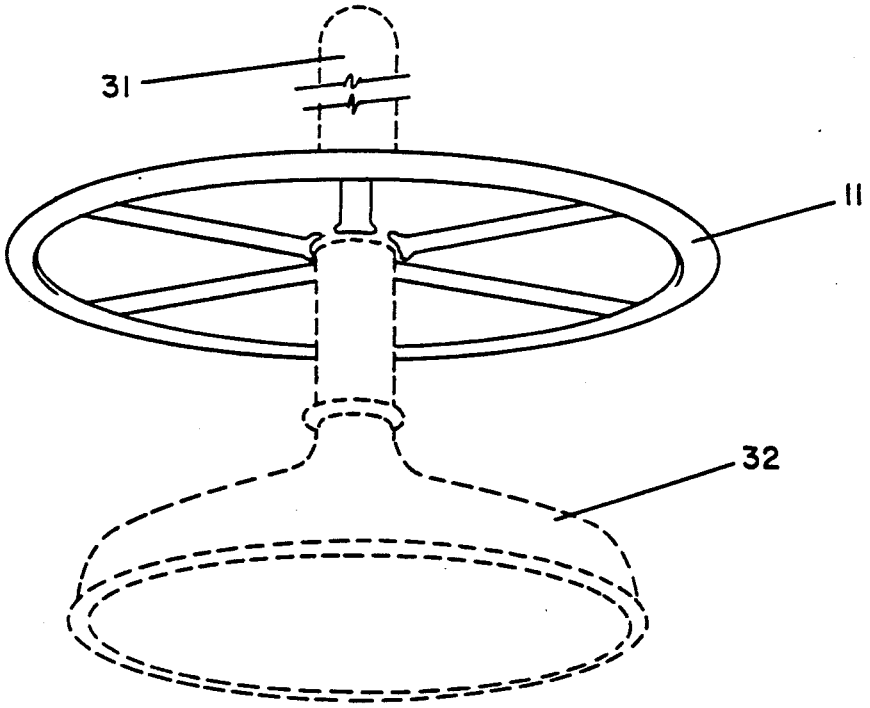
FIG. 4 is a bottom perspective view of the FIG. 3 embodiment mounted upon a plunger handle.
Figure 7:
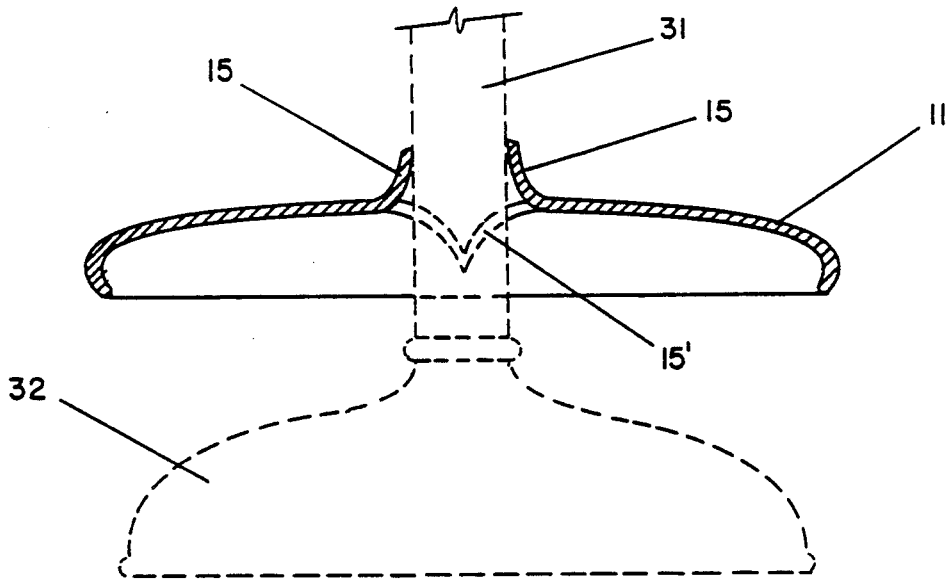
FIG. 7 is a side view of the splash deflector of FIGS. 5 and 6 installed on a plunger handle.

In the preferred embodiment, the disc 11 is placed over an elongate handle, such as a handle 31 attached to a plunger cup 32, and positioned in a desired location along the handle, such as shown in FIGS. 3–4 and 7. The flexible flaps 15,15' open to allow the handle 31 to pass therethrough. Indicia such as advertising 20, if utilized, should appear on the top surface of the disc 11, such as shown in FIG. 1.

Figure 5:
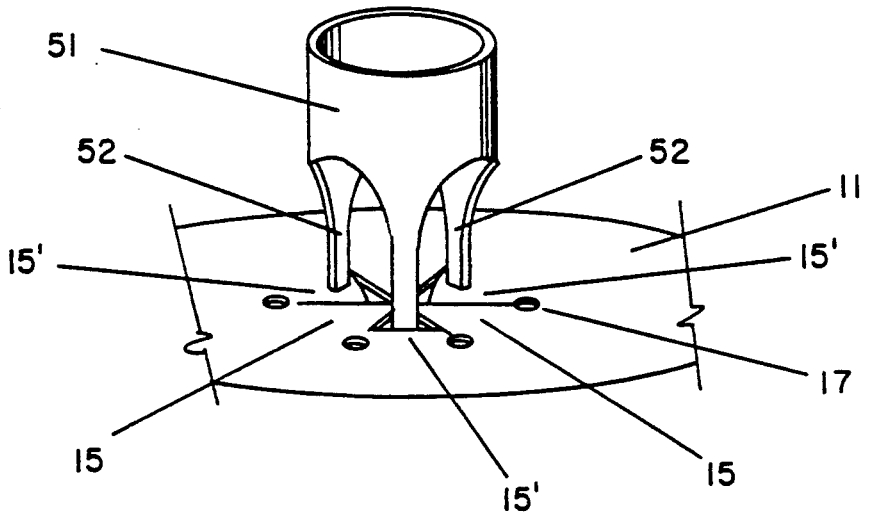
FIG. 5 is a top perspective view of a multi-fingered tube installation apparatus, in use prior to positioning on a handle.
Figure 6:
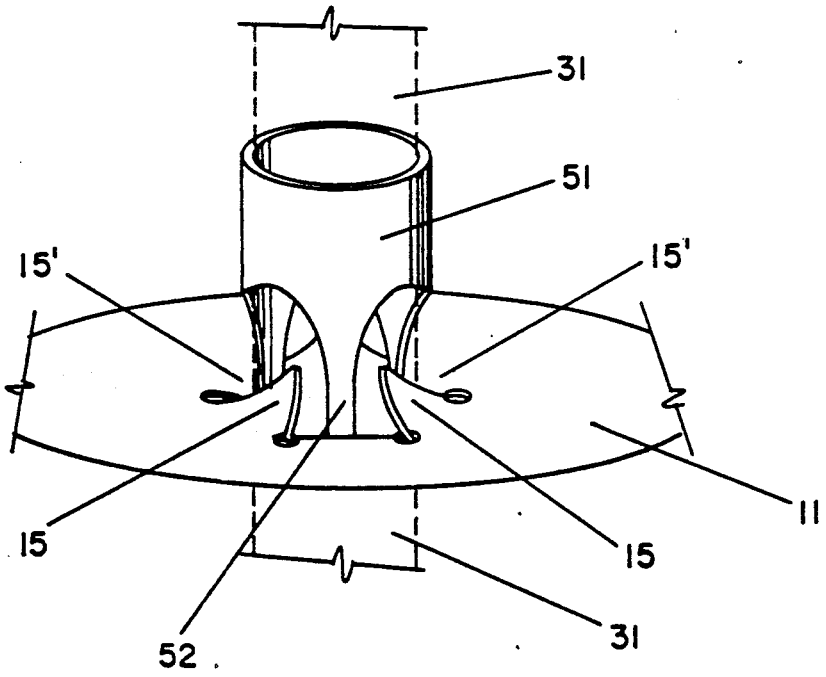
FIG. 6 is a top perspective view of the multi-fingered tube apparatus of FIG. 5, further in use, and upon positioning on a handle.

In an alternative embodiment, an installation apparatus, such as illustrated in FIGS. 5–6, is utilized for mounting disc 11 or other planar-shaped attachment to handle 31. This installation apparatus comprises a tube 51 having multiple teeth or fingers 52. The number of fingers and spaces between fingers 52 correspond to alternating triangular flaps 15 and 15' in disc 11. Apparatus 51 may be of plastic, metal, wood, or the like, the only requirement being that it possess rigidity. With specific reference to FIGS. 5 and 6, preferred mounting of splash deflector disc 11 to plunger handle 31 is accomplished in the following manner. Multi-fingered tube 51 is pressed against alternate flaps 15', thereby bending flaps 15' downwardly out of the plane of the disc 11 (see FIG. 5). Then, disc 11, with tube 51 partially inserted, is forced upon elongate handle 31 which results in flaps 15 being bent upwardly out of the plane of disc 11 (see FIG. 6). Movement of disc 11 downward along handle 31 is continued until the desired location of disc 11 relative to plunger cup 32 is reached. At such time, multi-fingered tube 51 is removed and disc 11 is firmly staked in position, as shown in FIG. 7. This preferred mounting means provides a firmer gripping force to the handle, especially longitudinally.

Although the invention has been described with reference to these preferred embodiments, other embodiments can achieve the same results. Variations and modifications of the present invention will be obvious to those skilled in the art and it is intended to cover in the appended claims all such modifications and equivalents.

What is claimed is:

1. A splash deflector for elongated handled drain plungers or the like comprising a combination of:

an elongate handle adapted to receive a drain plunger cup or the like on one end thereof;

a disc comprising a top surface and a bottom surface, wherein said bottom surface comprises a circumferential lip;

a plurality of slits extending radially from a substantially centered portion on said disc, said slits defining a plurality of flaps therebetween;

said disc being disposed on said elongate handle by said handle passing through said slit.

2. The invention of claim 1 wherein said circumferential lip curves downwardly from the top surface of said disc.

3. The invention of claim 2 wherein said circumferential lip also curves inwardly.

4. The invention of claim 1 wherein said slits and said flaps extend radially from the center of said disc.

5. The invention of claim 4 wherein said slits meet at said center of said disc.

6. The invention of claim 1 wherein said substantially centered portion comprises a central generally circular opening.

7. The invention of claim 1 wherein said flaps are generally triangularly shaped.

8. The invention of claim 1 further comprising means for stiffening said disc.

9. The invention of claim 8 wherein said stiffening means comprises a plurality of stiffening ribs disposed on at least one surface of said disc.

10. The invention of claim 1 further comprising means for preventing tearing or ripping of said disc.

11. The invention of claim 10 wherein said means for preventing tearing or ripping of said disc comprises circumferential rib means circumscribing said flaps on at least one surface of said disc.

12. The invention of claim 11 wherein said circumferential ribs means comprises a plurality of adjacent ribs.

13. The invention of claim 11 wherein said circumferential rib means comprises a continuous circular rib.

14. The invention of claim 10 wherein said means for preventing tearing or ripping of said disc comprises openings at the ends of said slits.

15. The invention of claim 1 wherein the top surface of said disc bears indicia thereon.

16. The invention of claim 15 wherein said indicia comprises advertising.

17. The invention of claim 1 wherein at least one of said plurality of flaps is disposed upwardly from the top surface of said disc.

18. The invention of claim 1 wherein at least one of said plurality of flaps is disposed downwardly from the bottom surface of said disc.

* * * * *